US010759191B2

(12) United States Patent
Ishihara et al.

(10) Patent No.: US 10,759,191 B2
(45) Date of Patent: Sep. 1, 2020

(54) PRINTING APPARATUS WITH CURVED FEED PATH

(71) Applicant: SEIKO EPSON CORPORATION, Tokyo (JP)

(72) Inventors: Masakazu Ishihara, Matsumoto (JP); Kazuhiro Nishiyama, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/435,828

(22) Filed: Jun. 10, 2019

(65) Prior Publication Data

US 2019/0381813 A1 Dec. 19, 2019

(30) Foreign Application Priority Data

Jun. 13, 2018 (JP) ..... 2018-112875

(51) Int. Cl.
*B41J 3/60* (2006.01)
*B41J 11/00* (2006.01)
*B41J 13/00* (2006.01)

(52) U.S. Cl.
CPC ..... *B41J 3/60* (2013.01); *B41J 11/0045* (2013.01); *B41J 13/00* (2013.01)

(58) Field of Classification Search
CPC ..... B41J 11/0045; B41J 29/13; B41J 29/02; B41J 29/023; B41J 3/60; B41J 13/103
See application file for complete search history.

(56) References Cited

U.S. PATENT DOCUMENTS 8,991,824 B2 * 3/2015 Suzuki ..... G03G 15/234 271/265.01
2010/0061743 A1 * 3/2010 Uematsu ..... G03G 15/234 399/38
2012/0161387 A1 6/2012 Horade
2012/0242034 A1 9/2012 Suzuki
2013/0257962 A1 10/2013 Oguchi
2015/0093160 A1 * 4/2015 Choi ..... B41J 11/005 399/322
2016/0167904 A1 6/2016 Nishii

FOREIGN PATENT DOCUMENTS

EP 1900534 3/2008
JP 2016-179688 A 10/2016
JP 2019112207 A 7/2019

OTHER PUBLICATIONS

European Search Report for EP 19179868 dated Oct. 29, 2019.

* cited by examiner

*Primary Examiner* — Henok D Legesse
(74) *Attorney, Agent, or Firm* — Workman Nydegger

(57) ABSTRACT

A printing apparatus includes an apparatus main body that houses the printing unit therein, and that includes a paper feeding port provided on the upper surface; an upper feeding path configured to guide the medium fed from the paper feeding port and including a first curved portion in a middle portion thereof for inverting the medium; a medium housing portion configured to house the medium; and a lower feeding path configured to guide the medium from the medium housing portion and including a second curved portion in a middle portion thereof for inverting the medium in a course of the guidance, in which an innermost portion of the first curved portion overlaps the second curved portion in a depth direction from the front surface toward a rear surface, which is on a side opposite to the front surface, of the apparatus main body when viewed from the upper surface.

8 Claims, 7 Drawing Sheets

PRINTING APPARATUS WITH CURVED FEED PATH

The present application is based on, and claims priority from JP Application Serial Number 2018-112875, filed Jun. 13, 2018, the disclosure of which is hereby incorporated by reference herein in its entirety.

BACKGROUND

1. Technical Field

The present disclosure relates to a printing apparatus such as an ink jet printer.

2. Related Art

JP-A-2016-179688 describes a recording apparatus having a manual feed tray on the rear surface thereof that is capable of stacking media as an example of a printing apparatus. This recording apparatus feeds the media stacked on the manual feed tray.

In the recording apparatus described in JP-A-2016-179688, because the media are fed from the rear surface on which the manual feed tray is provided, the rear surface of the apparatus tends to be large.

SUMMARY

A printing apparatus that solves the above-mentioned problems includes a printing unit that performs printing on a medium by using a liquid; an apparatus main body that houses the printing unit therein, that is configured to have outer surfaces that include an upper surface and a front surface that adjoiningly intersects the upper surface, and that includes a paper feeding port provided on the upper surface; an upper feeding path configured to guide the medium fed from the paper feeding port toward the printing unit and including a first curved portion in a middle portion thereof for inverting the medium in a course of the guidance; a medium housing portion provided on a lower portion of the apparatus main body and configured to house the medium; and a lower feeding path configured to guide the medium from the medium housing portion toward the printing unit and including a second curved portion in a middle portion thereof for inverting the medium in a course of the guidance, in which an innermost portion of the first curved portion overlaps the second curved portion in a depth direction from the front surface toward a rear surface, which is on a side opposite to the front surface, of the apparatus main body when viewed from the upper surface.

DESCRIPTION OF EXEMPLARY EMBODIMENTS

Hereinafter, an embodiment of a printing apparatus will be described with reference to the drawings.

Figure 1:
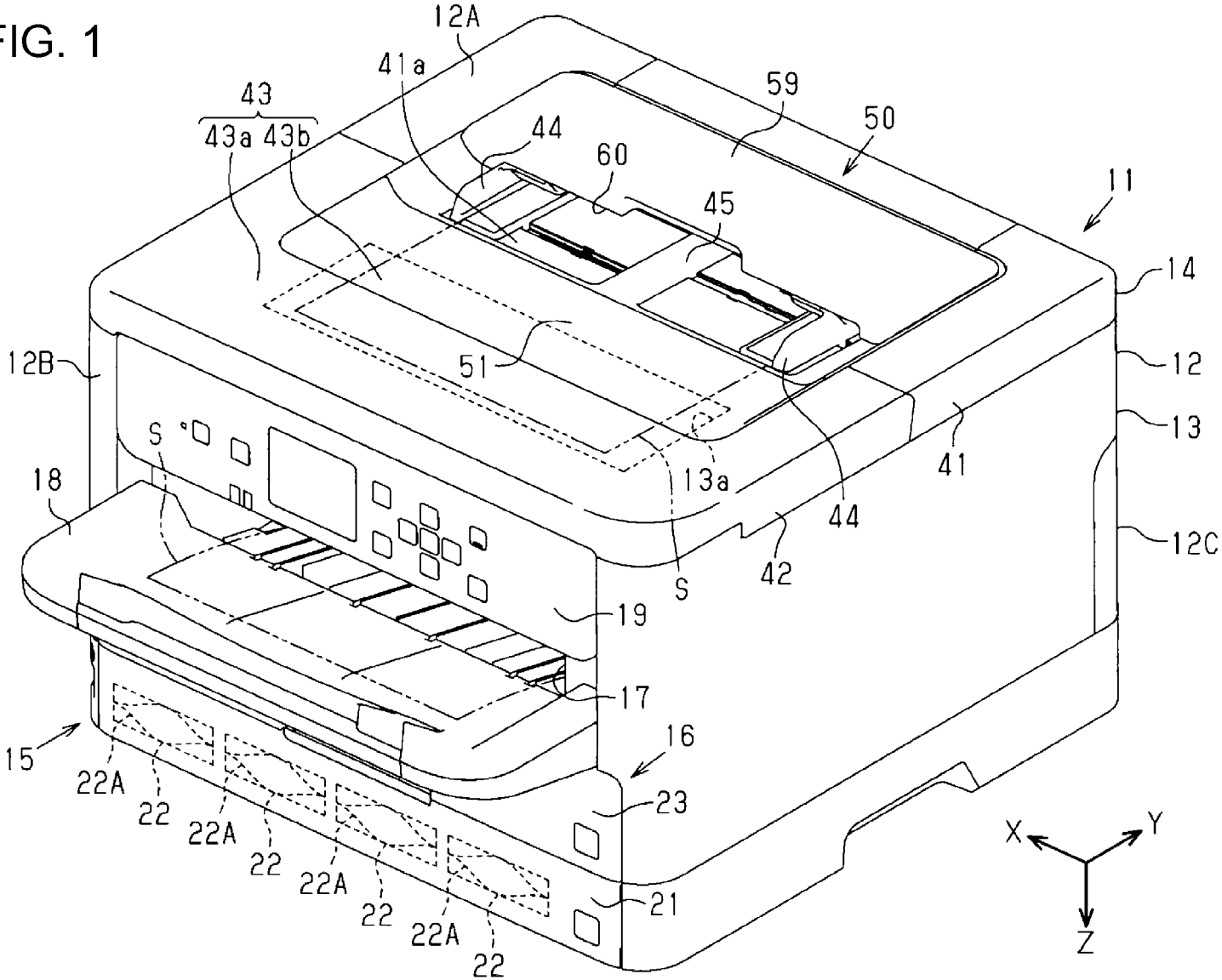
FIG. 1 is a perspective view illustrating an embodiment of a printing apparatus.

As illustrated in FIG. 1, a printing apparatus 11 of the present embodiment is an ink jet type printer that prints characters or images such as photographs by ejecting ink, which is an example of a liquid, onto a medium S such as a paper sheet.

The printing apparatus 11 includes an apparatus main body 12. The apparatus main body 12 has predetermined lengths as a width, a depth and a height, respectively, while mounted in a place of usage. In the drawing, the direction of gravity is indicated by the Z axis assuming that the printing apparatus 11 is placed on a horizontal plane, and the directions along a plane intersecting the Z axis are indicated by the X axis and the Y axis. The X axis, Y axis, and Z axis are perpendicular to each other. Therefore, the X axis and the Y axis are along the horizontal plane. When the depth direction of the apparatus main body 12 is indicated by the Y axis, the width direction of the apparatus main body 12 is indicated by the X axis. Therefore, in this specification, the X axis, the Y axis, and the Z axis are coordinate axes indicating the lengths of the width, the depth, and the height, respectively. In the following description, the X-axis direction is also referred to as a width direction X, the Y-axis direction as a depth direction Y, and the Z-axis direction as a vertical direction Z.

The outer surfaces of the apparatus main body 12 include an upper surface 12A and a front surface 12B that adjoiningly intersects the upper surface 12A. The printing apparatus 11 has, on the upper surface 12A of the apparatus main body 12, a paper feeding port 60 for feeding a medium S. The apparatus main body 12 of the present embodiment includes a casing 13 and a lid 14 attached to the casing 13. The casing 13 has an opening portion 13*a* on its upper surface. The lid 14 is attached to the casing 13 so as to close the opening portion 13*a*. In the present embodiment, the upper surface 12A of the apparatus main body 12 is formed by the upper surface of the lid 14. The front surface 12B of the apparatus main body 12 is formed by the front surface of the casing 13. The casing 13 and the lid 14 may be integrally formed.

The printing apparatus 11 includes a mounting portion 15 and a lower medium setting portion 16. The mounting portion 15 and the lower medium setting portion 16 are disposed in the apparatus main body 12 in order from a bottom portion side, which is the lower side in the vertical direction Z, to the upper side. A discharge port 17 through which the printed medium S is discharged, a discharge tray 18 extending forward from the discharge port 17, and an operation portion 19 for operating the printing apparatus 11 are disposed on the front surface 12B of the apparatus main body 12. The discharge port 17, the discharge tray 18, and the operation portion 19 are disposed above the lower medium setting portion 16. The medium S discharged from the discharge port 17 is placed on the discharge tray 18. The operation portion 19 includes, for example, buttons and the like. The front surface 12B of the apparatus main body 12 has a height and a width, and is a side surface on which operations are mainly performed for the printing apparatus 11. In the apparatus main body 12, the direction toward a rear surface 12C opposite to the front surface 12B is the depth direction Y. In the present embodiment, the rear surface 12C of the apparatus main body 12 is formed by the rear surface of the casing 13.

The mounting portion 15 is covered with a rotatable front lid 21 forming a portion of the front surface 12B of the apparatus main body 12. The mounting portion 15 is configured so that one or more containers 22 are mounted therein. The mounting portion 15 of the present embodiment is configured so that four containers 22 are mounted therein. The containers 22 are detachable from the mounting portion 15. Each of the containers 22 is configured so that a liquid housing portion 22A that houses the liquid is mounted therein. The liquid housing portions 22A are detachable from the containers 22. The liquid housed in the liquid housing portions 22A is a liquid used by the printing apparatus 11 to print on the medium S.

The liquid housing portions 22A house different types of liquid. The different types of liquid are, for example, inks of different colors such as black, cyan, magenta, and yellow. Each of the containers 22 can be mounted in the mounting portion 15 by itself without the liquid housing portions 22A held therein. The mounting portion 15 may be configured to enable the liquid housing portions 22A to be mounted therein without using the containers 22. That is, the mounting portion 15 is configured so that the liquid housing portions 22A are mounted therein. The liquid housing portions 22A are, for example, ink packs.

Figure 2:
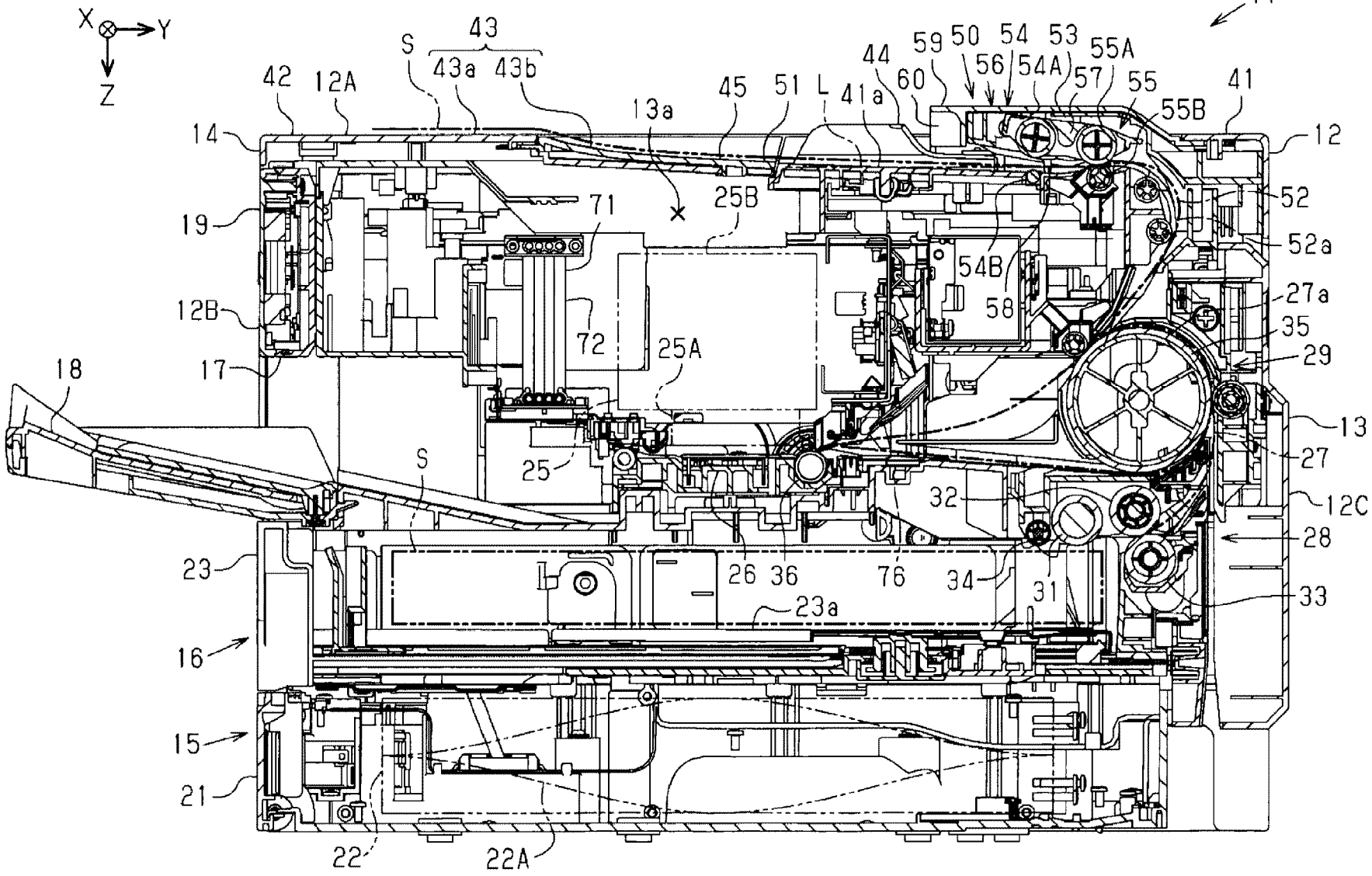
FIG. 2 is a side cross-sectional view schematically illustrating an internal structure of the printing apparatus.

As illustrated in FIG. 2, the lower medium setting portion 16 is configured so that a medium housing portion 23 is mounted therein. The medium housing portion 23 is configured to house the medium S. The medium housing portion 23 can house the medium S in a state where, for example, a plurality of media S are stacked. The medium housing portion 23 is detachable from the lower medium setting portion 16. That is, the medium housing portion 23 is provided at a lower portion of the apparatus main body 12 and is detachable from the apparatus main body 12.

The medium housing portion 23 is formed in a box shape with an upper portion thereof open. On an inner bottom surface 23*a* of the medium housing portion 23, the media S, prior to printing by the printing apparatus 11, are placed in a stacked state. The front surface of the medium housing portion 23 forms a portion of the front surface 12B of the apparatus main body 12 when the medium housing portion 23 is mounted in the apparatus main body 12.

The printing apparatus 11 includes a printing unit 25 and a medium supporting portion 26. The printing unit 25 and the medium supporting portion 26 are housed in the apparatus main body 12. The printing unit 25 and the medium supporting portion 26 are located above the lower medium setting portion 16. The printing unit 25 prints on the medium S using a liquid. The medium supporting portion 26 is disposed so as to face the printing unit 25 in the vertical direction Z and supports the medium S, on which printing is performed by the printing unit 25, from below. The printing unit 25 of the present embodiment has a head 25A from which liquid is ejected onto the medium S, and a carriage 25B on which the head 25A is mounted. The carriage 25B is configured to reciprocate in the width direction X.

The printing apparatus 11 includes liquid tubes 71 that connect the liquid housing portions 22A mounted in the mounting portion 15 and the printing unit 25 to each other. The liquid tubes 71 extend in the apparatus main body 12. The liquid tubes 71 guide the liquid from the liquid housing portions 22A mounted in the mounting portion 15 to the printing unit 25. The printing unit 25 performs printing on the medium S using the liquid supplied from the liquid housing portions 22A via the liquid tubes 71.

The printing apparatus 11 includes a lower feeding path 27 that guides the medium S housed in the medium housing portion 23, a supplying portion 28 that supplies the medium S from the medium housing portion 23, and a lower feeding portion 29 that feeds the medium S along the lower feeding path 27. The lower feeding path 27 is a path extending from the lower medium setting portion 16 toward the printing unit 25. The lower feeding path 27 is configured to guide the medium S from the medium housing portion 23 toward the printing unit 25.

The lower feeding path 27 has a second curved portion 27*a* for inverting the medium S in the course of guidance. The second curved portion 27*a* is provided in a middle portion of the lower feeding path 27. The second curved portion 27*a* in the present embodiment is a portion curved so as to invert the medium S in the lower feeding path 27. The lower feeding path 27, as indicated by a chain line in FIG. 2, extends upward from the rear of the lower medium setting portion 16, curves toward the front of the printing apparatus 11 in order to invert the medium S, and extends to a position between the printing unit 25 and the medium supporting portion 26.

The supplying portion 28 supplies the medium S housed in the medium housing portion 23 mounted in the lower medium setting portion 16 to the lower feeding path 27. The supplying portion 28 includes a pickup roller 31, a separate roller 32, a retard roller 33, and a pressing roller 34. The pickup roller 31 rotates in a state of being in contact with the surface of the medium S housed in the medium housing portion 23 mounted in the lower medium setting portion 16, thereby taking the medium S out from the medium housing portion 23. The separate roller 32 and the retard roller 33 rotate in a state in which the medium S taken out from the medium housing portion 23 by the rotation of the pickup roller 31 is nipped from both the front and rear sides, thereby supplying the medium S to the lower feeding path 27.

The pickup roller 31 is disposed above a rear end portion of the medium housing portion 23, which is mounted in the lower medium setting portion 16, in the depth direction Y. The pickup roller 31 rotates in a forward rotation direction which is a counterclockwise direction in FIG. 2, thereby taking the medium S out from the medium housing portion 23. The separate roller 32 and the retard roller 33 are disposed further to the rear side in the depth direction Y than the pickup roller 31 and are opposed to each other so as to nip the medium S from both the front and rear sides. The retard roller 33 is positioned below the separate roller 32. The rear side in the depth direction Y is the rear surface 12C side in the apparatus main body 12.

The retard roller 33 is a roller that is driven to rotate following the rotation of the separate roller 32. The retard roller 33 is configured so that the friction coefficient with respect to the medium S is larger than that of the separate roller 32. When a plurality of media S are taken out from the medium housing portion 23 in a state of being overlapped with each other, the separate roller 32 and the retard roller 33 separate and transport the media S one by one due to this difference in friction coefficient. The pressing roller 34 is disposed on the opposite side to where the separate roller 32 and the retard roller 33 are positioned with respect to the pickup roller 31, that is, in front of the pickup roller 31 in the depth direction Y. The pressing roller 34 presses the medium S housed in the medium housing portion 23 from above.

The lower feeding portion 29 feeds the medium S supplied by the supplying portion 28 along the lower feeding path 27. The lower feeding portion 29 has a plurality of rollers arranged along the lower feeding path 27. The lower feeding portion 29 of the present embodiment has a first feeding roller 35 and a second feeding roller 36. In the lower feeding path 27, the first feeding roller 35 and the second feeding roller 36 are disposed in order from upstream.

The lower feeding portion 29 may be configured to have rollers other than the first feeding roller 35 and the second feeding roller 36. In the present embodiment, the first feeding roller 35 is disposed immediately above the separate roller 32. The first feeding roller 35 feeds the medium S while curving the medium S at the second curved portion 27*a*. Therefore, the second curved portion 27*a* of this embodiment is a portion curved by the first feeding roller 35 in the lower feeding path 27. The medium S fed through the lower feeding path 27 is curved along the circumferential surface of the first feeding roller 35 at the second curved portion 27*a*.

The first feeding roller 35 transports the medium S fed by the supplying portion 28 while curving the medium S along the lower feeding path 27 from the upper side to the second feeding roller 36 in front. The first feeding roller 35 may transport the medium S supplied from the paper feeding port 60 disposed on the upper surface 12A of the apparatus main body 12 to the middle of the lower feeding path 27 and transport it forward. The second feeding roller 36 is provided at a position downstream in the lower feeding path 27 and is arranged adjacent to the medium supporting portion 26. The second feeding roller 36 transports the medium S transported by the first feeding roller 35 forward along the lower feeding path 27.

The printing apparatus 11 includes a guide path 76 configured to guide the medium S from the printing unit 25 to the lower feeding path 27 so as to perform printing on both sides of the medium S. The guide path 76 extends from between the printing unit 25 and the medium supporting portion 26 so as to be linked to the lower feeding path 27. The guide path 76 passes under the first feeding roller 35.

The medium S supplied from the lower medium setting portion 16 or an upper medium setting portion 50 is printed on one side thereof by the printing unit 25. When the second feeding roller 36 rotates in a reverse direction, the medium S printed on one side is fed through the guide path 76. The medium S printed on one side is fed to the lower feeding path 27 via the guide path 76.

The posture of the medium S fed through the lower feeding path 27 is inverted by the second curved portion 27*a*. As a result, the medium S has a posture in which the other side opposite to the one side faces the printing unit 25. In this manner, the printing apparatus 11 prints on both sides of the medium S.

The lower feeding portion 29 transports the medium S taken out from the medium housing portion 23 by the pickup roller 31 onto the medium supporting portion 26 disposed downstream in the lower feeding path 27. At this time, after the medium S has been taken out from the medium housing portion 23 to the rear side, because it is fed to the front side while being curved toward the medium supporting portion 26, the posture of the medium S is inverted vertically from when the medium S is located inside the medium housing portion 23 to when it is positioned on the medium supporting portion 26. The width direction of the medium S to be fed coincides with the width direction X of the apparatus main body 12. The medium S on which printing by the printing unit 25 has been completed is discharged onto the discharge tray 18 from the discharge port 17 located in front of the printing unit 25 in the apparatus main body 12.

Figure 3:
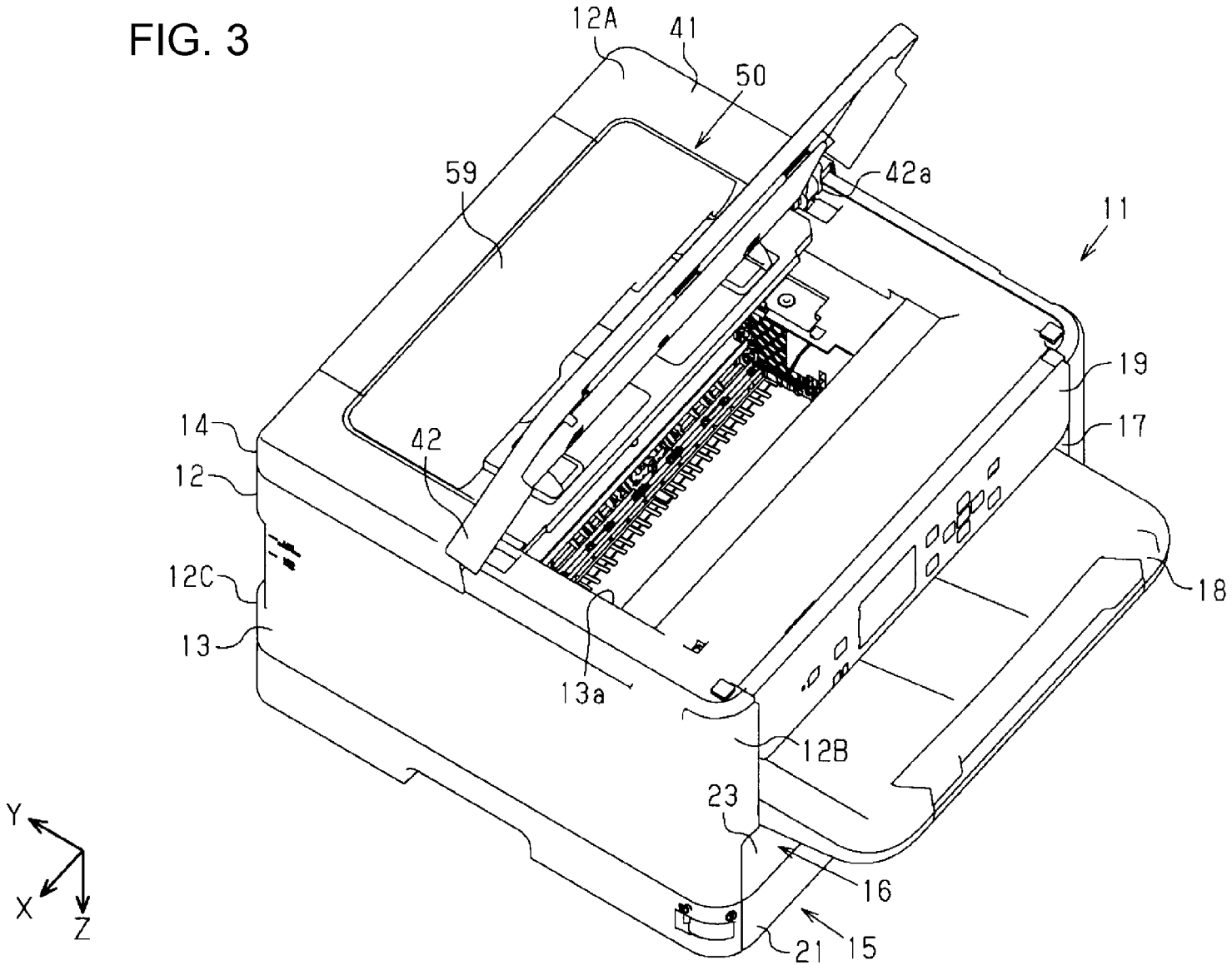
FIG. 3 is a perspective view illustrating the printing apparatus when a second lid is positioned at an open position.

As illustrated in FIG. 3, the lid 14 has a first lid 41 and a second lid 42. The first lid 41 is located on an upper surface of the casing 13 near the rear surface 12C of the apparatus main body 12. The first lid 41 is fixed to the casing 13. The second lid 42 is located close to the front surface 12B of the apparatus main body 12 on the upper surface of the casing 13. The second lid 42 is attached to the casing 13 so as to cover the opening portion 13*a* formed on the upper surface of the casing 13.

The second lid 42 is attached to the casing 13 via a hinge 42*a*. The second lid 42 is configured to pivot with respect to the casing 13 by the hinge 42*a*. The second lid 42 is configured to be displaced between an open position in which the opening portion 13*a* is open and a closed position in which the opening portion 13*a* is closed. The second lid 42 illustrated in FIG. 3 is positioned at the open position. By positioning the second lid 42 at the open position, the interior of the apparatus main body 12 can be visually recognized from the opening portion 13*a*.

As illustrated in FIGS. 1 and 2, the printing apparatus 11 includes the upper medium setting portion 50. The upper medium setting portion 50 is provided on the upper surface 12A of the apparatus main body 12. The printing apparatus 11 includes an upper feeding path 52 extending from the upper medium setting portion 50 toward the printing unit 25. The upper medium setting portion 50 is located above the lower medium setting portion 16. In the vertical direction Z, the printing unit 25 is positioned between the upper medium setting portion 50 and the lower medium setting portion 16.

The upper medium setting portion 50 includes a medium placement surface 51 on the upper surface of the lid 14 that forms the upper surface 12A of the apparatus main body 12. The medium placement surface 51 is formed on the upper surface of the lid 14 at a center portion thereof in the width direction X. The medium placement surface 51 is composed of a first placement surface 41*a* provided on the upper surface of the first lid 41 and a second placement surface 43 provided on the upper surface of the second lid 42. The first placement surface 41*a* is inclined so as to descend in the depth direction Y. That is, the first placement surface 41*a* is inclined so as to descend from the front surface 12B side to the rear surface 12C side of the apparatus main body 12.

The second placement surface 43 is composed of an upstream horizontal surface 43*a* and a downstream inclined surface 43*b*. The upstream horizontal surface 43*a* is positioned close to the front surface 12B of the apparatus main body 12 on the upper surface of the second lid 42. The downstream inclined surface 43*b* is positioned close to the rear surface 12C of the apparatus main body 12 on the upper surface of the second lid 42. The upstream horizontal surface 43*a* and the downstream inclined surface 43*b* are continuous in the depth direction Y. The downstream inclined surface 43*b* and the first placement surface 41*a* of the second placement surface 43 are continuous in the depth direction Y. As described above, the upstream horizontal surface 43*a*, the downstream inclined surface 43*b*, and the first placement surface 41*a* are continuous in the depth direction Y, whereby the medium placement surface 51 is formed.

An inclined surface 45, which is continuous and inclined so as to descend in the depth direction Y, is formed by the downstream inclined surface 43*b* of the second placement surface 43 and the first placement surface 41*a*. The medium placement surface 51 is formed by the upstream horizontal surface 43*a* and the inclined surface 45. The inclined surface 45 is positioned lower than the upstream horizontal surface 43*a* in the vertical direction Z. Therefore, the inclined surface 45 is provided so as to be recessed from the upstream horizontal surface 43*a*. Due to the inclined surface 45, a recessed portion recessed from the upstream horizontal surface 43*a* is provided on the upper surface 12A of the apparatus main body 12.

When the medium S placed on the medium placement surface 51 is a postcard, the entire medium S is placed on the inclined surface 45. In this case, the medium S is housed in the recessed portion. When the medium S placed on the medium placement surface 51 is an A4 size sheet, the medium S is placed on the upstream horizontal surface 43*a* and the inclined surface 45. In this case, a portion of the medium S is housed in the recessed portion. A pair of edge guides 44 that can slide reciprocally in the width direction X are provided on the first placement surface 41*a*. The medium S placed on the first placement surface 41*a* is positioned in the width direction X by being interposed between the pair of edge guides 44.

Figure 4:
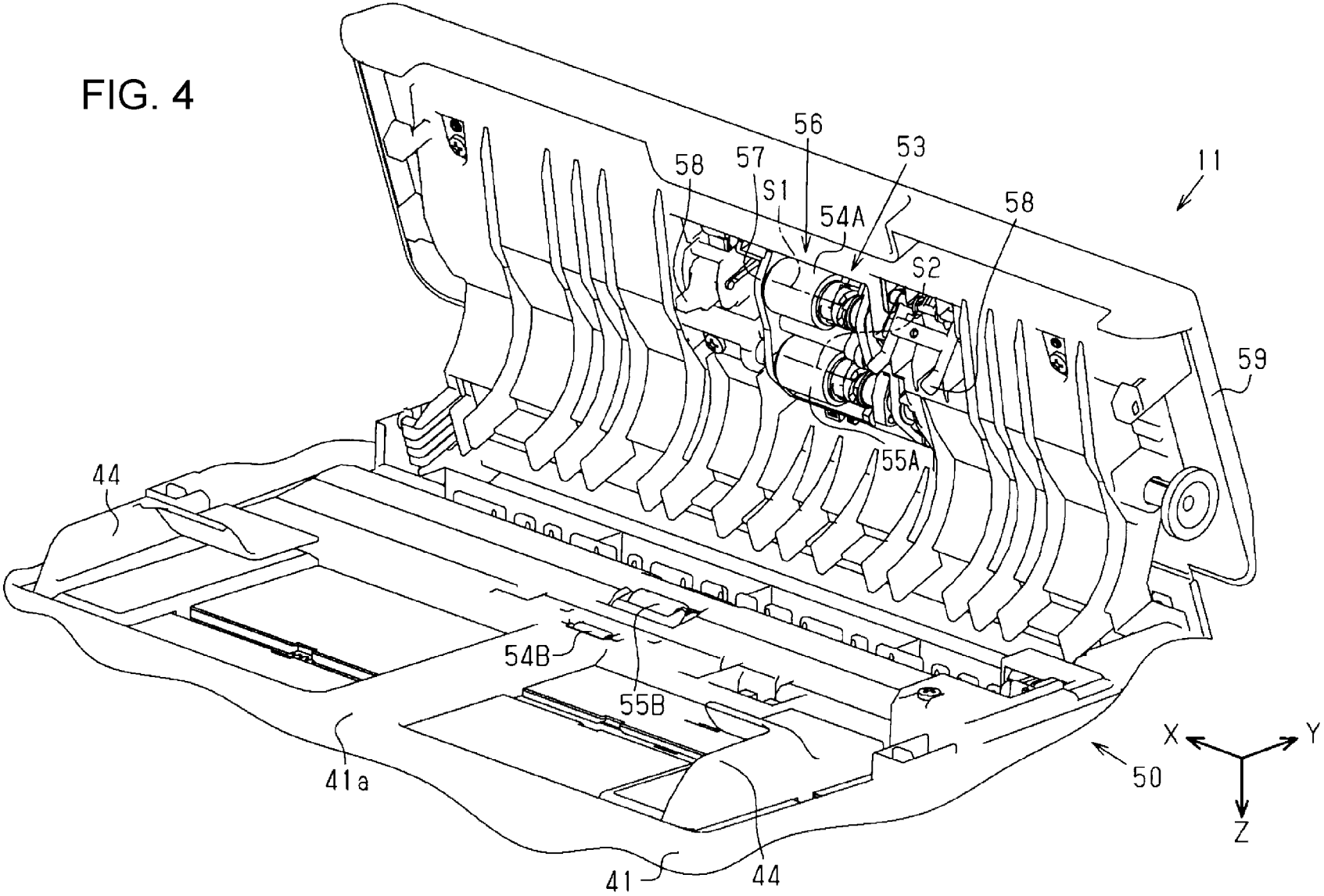
FIG. 4 is a perspective view illustrating the printing apparatus when an inverting cover is positioned at an open position.

As illustrated in FIGS. 2 and 4, an inverting cover 59 is attached to the first lid 41. The inverting cover 59 forms the upper medium setting portion 50. The inverting cover 59 is attached so as to pivot with respect to the first lid 41. The inverting cover 59 is configured to be displaceable between an open position where the first placement surface 41*a* of the medium placement surface 51 is exposed and a closed position where the inverting cover 59 covers the first placement surface 41*a* from the upper side. The inverting cover 59 illustrated in FIG. 2 is positioned at the closed position. The inverting cover 59 illustrated in FIG. 4 is positioned at the open position.

The paper feeding port 60 is formed on the upper surface 12A of the apparatus main body 12. The paper feeding port 60 enables the medium S to be fed into the apparatus main body 12. When the inverting cover 59 is positioned at the closed position, the paper feeding port 60 of the present embodiment is formed between the first placement surface 41*a* having a downward slope toward the rear surface 12C of the apparatus main body 12 and a front end of the inverting cover 59, which is horizontal, on the upper surface 12A of the apparatus main body 12.

The paper feeding port 60 is formed so as to face the front surface 12B side of the apparatus main body 12. With respect to the positional relationship with the paper feeding port 60, the medium placement surface 51 is provided so as to extend toward the paper feeding port 60 along a paper feeding direction from a position closer to the front surface 12B of the apparatus main body 12 than is the paper feeding port 60. The media S may be fed one by one by manual insertion by the user via the paper feeding port 60 or a plurality of media S may be fed collectively.

The first lid 41 is provided downstream in the paper feeding direction when viewed from the paper feeding direction. The second lid 42 is provided upstream in the paper feeding direction. The first placement surface 41*a* of the medium placement surface 51 is inclined so as to descend from upstream to downstream in the paper feeding direction, the upstream horizontal surface 43*a* of the second placement surface 43 is located upstream in the paper feeding direction, and the downstream inclined surface 43*b* is inclined so as to descend from upstream to downstream in the paper feeding direction downstream of the upstream horizontal surface 43*a* in the paper feeding direction.

The inclined surface 45 of the medium placement surface 51 is formed such that the downstream inclined surface 43*b* of the second placement surface 43 and the first placement surface 41*a* are continuous in the paper feeding direction. The inclined surface 45 is inclined so as to descend from upstream to downstream in the paper feeding direction.

The printing apparatus 11 includes the upper feeding path 52 configured to guide the medium S fed from the paper feeding port 60 toward the printing unit 25. The medium S fed from the paper feeding port 60 is fed to the printing unit 25 via the upper feeding path 52 provided in the apparatus main body 12. An end portion of the upper feeding path 52, as indicated by a chain line in FIG. 2, on the opposite side to the end portion on the side of the paper feeding port 60 is joined to the lower feeding path 27 on the peripheral surface of the first feeding roller 35.

The upper feeding path 52 has a first curved portion 52*a* for inverting the medium S in the course of guidance. The first curved portion 52*a* is provided in a middle portion of the upper feeding path 52. The first curved portion 52*a* is a portion curved in order to invert the medium S in the upper feeding path 52. The upper feeding path 52 extends downward from a position closer to the rear surface 12C of the apparatus main body 12 than is the paper feeding port 60 by the first curved portion 52*a* and then curves toward the front obliquely downward where a junction point of the lower feeding path 27 is located. When the medium S passes through the first curved portion 52*a* in the upper feeding path 52, the front and rear sides thereof become inverted.

The printing apparatus 11 is configured such that the innermost portion of the first curved portion 52*a* and the second curved portion 27*a* overlap in the depth direction Y when viewed from the upper surface. That is, the upper feeding path 52 and the lower feeding path 27 extend within the apparatus main body 12 so that the innermost portion of the first curved portion 52*a* and the second curved portion 27*a* overlap in the depth direction Y. In this way, the upper feeding path 52 and the lower feeding path 27 can be made compact. Consequently, it is possible to suppress an increase in the size of the printing apparatus 11. In particular, it is possible to suppress an increase in the size of the printing apparatus 11 in the depth direction Y. In the present embodiment, the innermost portion of the first curved portion 52*a* is located above the second curved portion 27*a*. The innermost portion of the first curved portion 52*a* is a rearmost portion of the first curved portion 52*a*. That is, the innermost portion of the first curved portion 52*a* in this embodiment is a portion of the first curved portion 52*a* farthest in the depth direction Y from the front surface 12B of the apparatus main body 12.

The printing apparatus 11 is configured such that the first curved portion 52*a* and the carriage 25B overlap in the vertical direction Z. That is, the upper feeding path 52 extends within the apparatus main body 12 such that the first curved portion 52*a* and the carriage 25B overlap in the vertical direction Z. In this way, the upper feeding path 52 can be made compact. Consequently, it is possible to suppress an increase in the size of the printing apparatus 11. In particular, it is possible to suppress an increase in the size of the printing apparatus 11 in the vertical direction Z.

As illustrated in FIG. 2, the printing apparatus 11 includes an upper feeding portion 53 that feeds the medium S along the upper feeding path 52. The upper feeding portion 53 includes a pair of first rollers 54 and a pair of second rollers 55. In the upper feeding path 52, the pair of first rollers 54 and the pair of second rollers 55 are located closer to the side where the paper feeding port 60 is located than is the first curved portion 52*a*. The upper feeding portion 53 feeds the medium S toward the printing unit 25 via the upper feeding path 52 by the pair of first rollers 54 and the pair of second rollers 55, which correspond to a pair of feeding rollers, rotating while nipping the medium S, which has been fed from the paper feeding port 60, from the front and rear sides. In this respect, the upper feeding path 52 is capable of guiding the medium S fed from the paper feeding port 60 toward the printing unit 25 in the apparatus main body 12, and functions as a feeding path having, in its middle portion, the first curved portion 52*a* for inverting the medium S in the course of guidance.

In the upper feeding path 52, the pair of first rollers 54 are located closer to the side where the paper feeding port 60 is located than are the pair of second rollers 55. That is, the pair of first rollers 54 are located upstream of the pair of second rollers 55 in the upper feeding path 52. In the depth direction Y, the pair of first rollers 54 of the present embodiment are located closer to the front surface 12B of the apparatus main body 12 than are the pair of second rollers 55.

The pair of first rollers 54 are formed of a driving roller 54A provided on the inverting cover 59 and a separation roller 54B provided on the first lid 41. The separation roller 54B is configured so that the friction coefficient of the outer peripheral surface thereof with respect to the medium S is larger than the friction coefficient of the outer peripheral surface of the driving roller 54A with respect to the medium S. The separation roller 54B is configured to rotate at a slightly lower speed than the driving roller 54A. Even if a plurality of media S overlap and are fed, by using the difference in friction coefficient and the rotational speed difference between the outer peripheral surfaces of both the driving roller 54A and the separation roller 54B, the pair of first rollers 54 separate the lowermost sheet and feed it downstream in the paper feeding direction.

In the depth direction Y, the pair of first rollers 54 are located closer to the side where the printing unit 25 is located than is the first feeding roller 35. Consequently, the printing apparatus 11 can be made compact. In the depth direction Y, the pair of first rollers 54 of the present embodiment are located closer to the front surface 12B of the apparatus main body 12 than is the first feeding roller 35.

In the depth direction Y, the pair of first rollers 54 are located closer to the side where the printing unit 25 is located than is the second curved portion 27*a*. Consequently, the printing apparatus 11 can be made compact. In the depth direction Y, the pair of first rollers 54 of the present embodiment are located closer to the front surface 12B of the apparatus main body 12 than is the second curved portion 27*a*.

The pair of second rollers 55 are formed of a driving roller 55A provided on the inverting cover 59 and a driven roller 55B provided on the first lid 41. As illustrated in FIG. 2, the pair of second rollers 55 are provided so that the nipping point at which the medium S is nipped by the driving roller 55A and the driven roller 55B is located on an extension line L of the inclined surface 45 of the medium placement surface 51. The pair of second rollers 55 are driven so as to rotate and so as to transport the medium S at the same transport speed as the pair of first rollers 54. The separation roller 54B and the driven roller 55B rotate together with the rotation of the pair of driving rollers 54A and 55A.

As illustrated in FIGS. 2 and 4, the driving rollers 54A and 55A are, as a delivery roller unit 56, swingably supported by the inverting cover 59. The delivery roller unit 56 includes a frame body 57 having a generally rectangular shape in plan view. Inside the frame body 57, the driving rollers 54A and 55A are supported so as to be rotatable around axes S1 and S2 extending in the width direction X of the apparatus main body 12 in a state where the driving rollers 54A and 55A are juxtaposed parallel to each other. In the frame body 57, the driving roller 55A and the driven roller 55B of the pair of second rollers 55 are always arranged on the swing fulcrum side of the frame body 57 so that the driving roller 55A and the driven roller 55B always come into contact with each other, and the driving roller 54A of the pair of first rollers 54 is disposed on the front side of the driving roller 55A.

The delivery roller unit 56 is configured to be displaceable between a delivery position where the driving roller 54A of the pair of first rollers 54 is in contact with the separation roller 54B and a non-delivery position where it is separated upward from the separation roller 54B.

The upper feeding portion 53 includes stoppers 58 disposed at positions interposing the pair of first rollers 54 in the width direction X. The stoppers 58 are arranged at positions where the medium S inserted toward the pair of first rollers 54 comes into contact when the delivery roller unit 56 is in the non-delivery position. In addition, the stoppers 58 are adapted to retreat toward the inverting cover 59 when the delivery roller unit 56 is in the delivery position. The lower portion of the delivery roller unit 56 enters a recessed portion formed by provision of the inclined surface 45.

Figure 5:
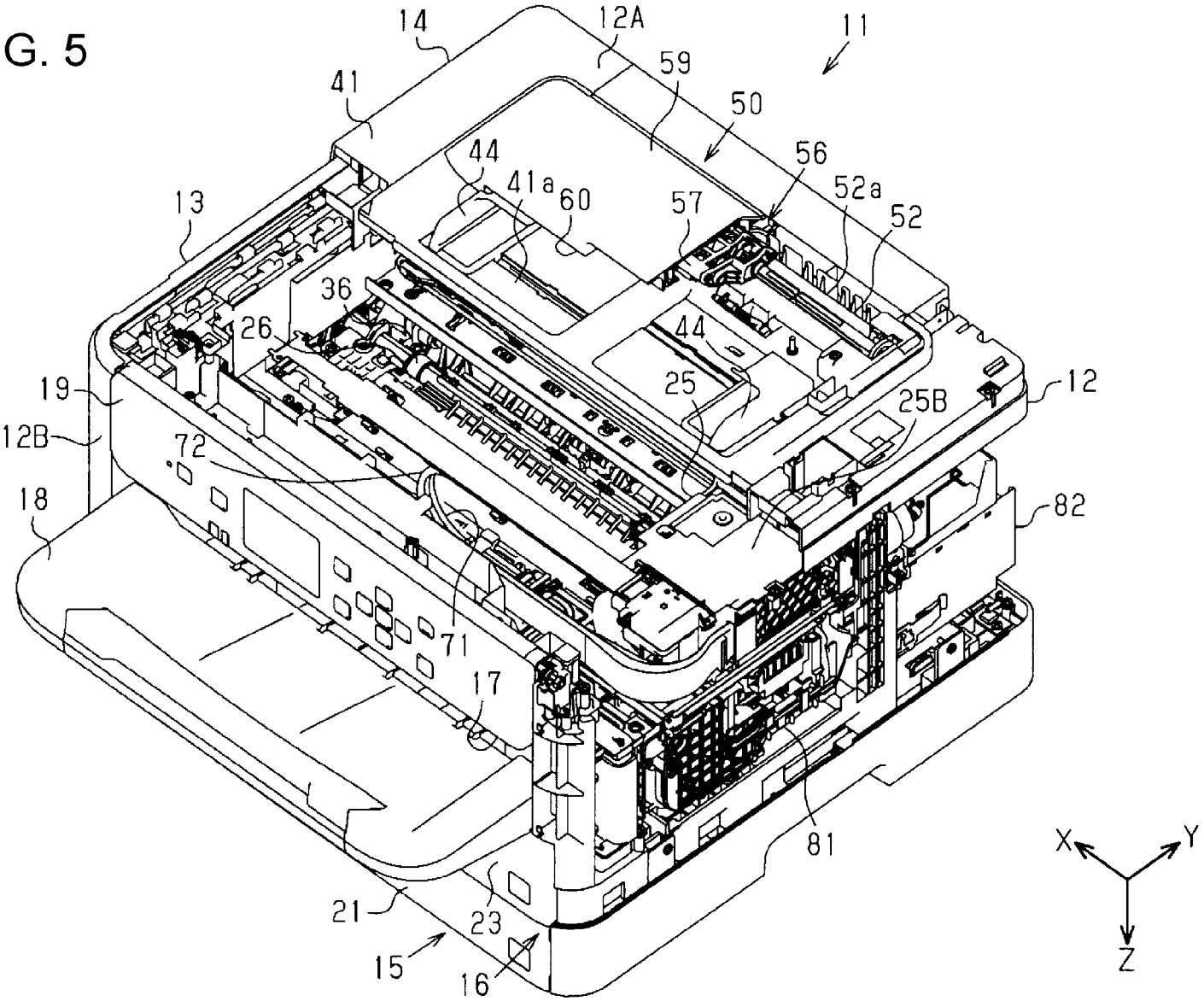
FIG. 5 is a perspective view illustrating the internal structure of the printing apparatus.
Figure 6:
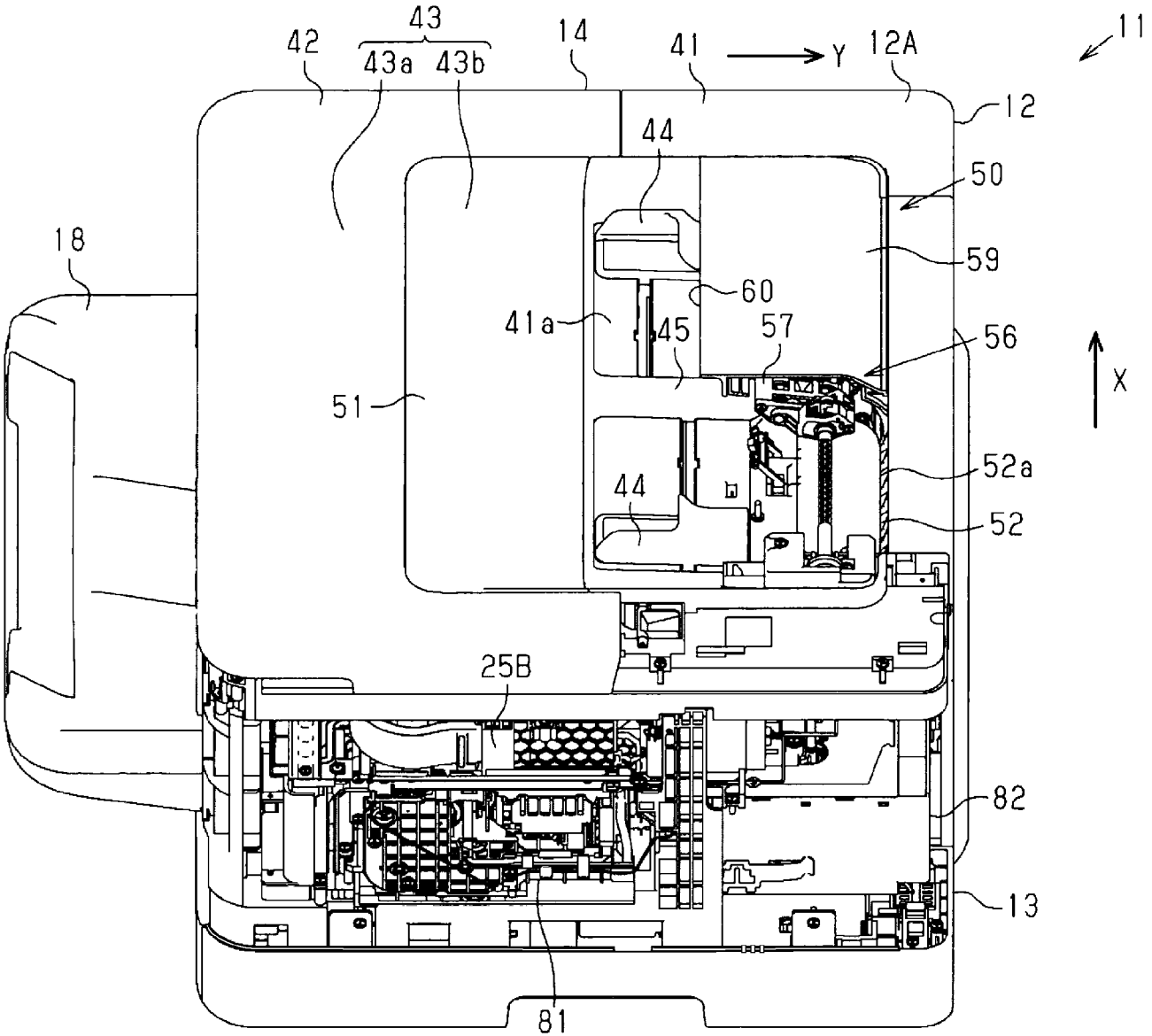
FIG. 6 is a perspective view illustrating the internal structure of the printing apparatus.

As illustrated in FIGS. 5 and 6, the printing apparatus 11 includes a maintenance mechanism 81 for maintaining the printing unit 25. The maintenance mechanism 81 is configured to receive the liquid discharged as waste liquid from the printing unit 25. The maintenance mechanism 81 is positioned so as to be adjacent to the medium supporting portion 26 in the width direction X.

Maintenance of the printing unit 25 includes, for example, flushing, cleaning, and the like. Flushing is an operation in which the printing unit 25 ejects liquid irrespective of printing. Cleaning is, for example, an operation of forcibly ejecting liquid from the printing unit 25 by using a pump or the like. By flushing and cleaning, thickened liquid can be discharged in the printing unit 25. Thereby, the printing quality of the printing apparatus 11 is maintained.

The printing apparatus 11 has a waste liquid box 82 that stores waste liquid from the printing unit 25. The waste liquid box 82 is positioned so as to be adjacent to the maintenance mechanism 81 in the depth direction Y. The waste liquid box 82 houses the waste liquid discharged to the maintenance mechanism 81. The waste liquid box 82 may be configured to be detachable from the apparatus main body 12. In this way, the waste liquid box 82 can be exchanged. The waste liquid box 82 may directly house waste liquid from the printing unit 25.

The printing apparatus 11 is configured such that the upper feeding path 52 and the waste liquid box 82 overlap each other in the depth direction Y. That is, the upper feeding path 52 extends inside the apparatus main body 12 so as to overlap with the waste liquid box 82 in the depth direction Y. In this way, the upper feeding path 52 can be made compact. In the present embodiment, the upper feeding path 52 is provided so that the first curved portion 52*a* and the waste liquid box 82 overlap in the depth direction Y. The first curved portion 52*a* of the present embodiment is, in the upper feeding path 52, a portion from the nip point of the pair of second rollers 55 to a junction point where the upper feeding path 52 and the lower feeding path 27 join.

The liquid tubes 71 extend in the width direction X in the apparatus main body 12. The liquid tubes 71 are configured to follow the movement of the carriage 25B. The liquid tubes 71 have a turn-back portion 72 that turns back in the width direction X. The turn-back portion 72 is formed in the middle of the liquid tubes 71. The liquid tubes 71 of the present embodiment have the turn-back portion 72 curved in a U shape. As the carriage 25B moves, the position where the turn-back portion 72 of the liquid tubes 71 is formed moves. In this manner, the liquid tubes 71 deform so as to follow the movement of the carriage 25B.

The printing apparatus 11 is configured such that the turn-back portion 72 and the upper feeding path 52 overlap each other in the vertical direction Z. That is, the upper feeding path 52 extends within the apparatus main body 12 so as to overlap the turn-back portion 72 of the liquid tubes 71 when viewed from the front surface in the vertical direction Z. In this way, the upper feeding path 52 can be made compact. Consequently, it is possible to suppress an increase in the size of the printing apparatus 11. In particular, it is possible to suppress an increase in the size of the printing apparatus 11 in the vertical direction Z. In the present embodiment, the upper feeding path 52 is provided so that the first curved portion 52*a* and the turn-back portion 72 overlap.

Next, the operation of the above embodiment will be described. Further, as a prerequisite for the explanation, in a stage before the operation portion 19 is operated, it is assumed that the delivery roller unit 56 is in the delivery position where the driving roller 54A is in contact with the separation roller 54B and the stoppers 58 are in a position retracted toward the inverting cover 59.

When printing is performed by the printing unit 25 on the medium S fed by manual insertion into the upper medium setting portion 50, the medium S is inserted from the paper feeding port 60 until it comes into contact with the nip point of the pair of first rollers 54 and the medium S is made to reach the upper feeding portion 53. At this time, the end of the medium S abuts against the pair of first rollers 54, but, because it is not yet curved at this point and is in a flat state along the medium placement surface 51, curving, which is likely to occur when the medium S abuts against the pair of first rollers 54 in a curved state, is suppressed. When the operation portion 19 is operated to start printing, the pair of first rollers 54 are driven to feed the medium S toward the pair of second rollers 55 positioned downstream in the paper feeding direction. At this time, the end of the medium S abuts against the pair of second rollers 55, but, because it is not yet curved at this point and is in a flat state along the medium placement surface 51, curving, which is likely to occur when the medium S abuts against the pair of second rollers 55 in a curved state, is suppressed. The pair of second rollers 55 rotate so as to transport the medium S at the same transport speed as that of the pair of first rollers 54 and feed the medium downstream in the paper feeding direction.

The medium S fed by the upper feeding portion 53 is inverted via the first curved portion 52*a* of the upper feeding path 52 and then fed toward a junction point of the lower feeding path 27 located on the peripheral surface of the first feeding roller 35. The first feeding roller 35 feeds the medium S while curving the medium S along the lower feeding path 27 from the upper side to the front side. The second feeding roller 36 transports the medium S fed by the first feeding roller 35 forward along the lower feeding path 27. The medium S transported onto the medium supporting portion 26 is printed on by the printing unit 25. The medium S on which printing has been completed is discharged from the discharge port 17 onto the discharge tray 18.

Next, effects of the above embodiment will be described.

(1) The innermost portion of the first curved portion 52*a* of the upper feeding path 52 that guides the medium S fed from the paper feeding port 60 that opens on the upper surface 12A of the apparatus main body 12 and the second curved portion 27*a* of the lower feeding path 27 that guides the medium S from the medium housing portion 23 that houses the medium S overlap in the depth direction Y. Consequently, the upper feeding path 52 and the lower feeding path 27 can be made compact. Therefore, it is possible to suppress an increase in the size of the printing apparatus 11.

(2) The upper feeding path 52 and the turn-back portion 72 of the liquid tube 71 overlap in the vertical direction Z when viewed from the front surface. Consequently, the upper feeding path 52 can be made compact. Therefore, it is possible to suppress an increase in the size of the printing apparatus 11.

(3) The upper feeding path 52 and the waste liquid box 82 overlap in the depth direction Y. Consequently, the upper feeding path 52 can be made compact. Therefore, it is possible to suppress an increase in the size of the printing apparatus 11.

(4) The first curved portion 52*a* and the carriage 25B overlap in the vertical direction Z. Consequently, the upper feeding path 52 can be made compact.

(5) By providing the guide path 76, duplex printing for printing on both sides of the medium S can be executed.

(6) In the depth direction Y, the pair of first rollers 54 are located closer to the side where the printing unit 25 is located than is the first feeding roller 35. Consequently, the printing apparatus 11 can be made compact.

(7) In the depth direction Y, the pair of first rollers 54 are located closer to the side where the printing unit 25 is located than is the second curved portion 27*a*. Consequently, the printing apparatus 11 can be made compact.

(8) The medium S, which is fed from the paper feeding port 60 into the apparatus main body 12 and is guided toward the printing unit 25 via the upper feeding path 52, strikes the pair of first rollers 54 before the end thereof reaches the first curved portion 52*a* in the upper feeding path 52. Then, from this state, the pair of first rollers 54 rotate while nipping the medium S from the front and rear sides so that the fed medium S is fed to the printing unit 25 along the first curved portion 52*a*. That is, even though the fed medium S curves when it passes through the first curved portion 52*a* of the upper feeding path 52, the medium S abuts against the pair of first rollers 54 before curving and does not become curved. Therefore, it is possible to suppress curving of the fed medium S when it is fed through a curved path toward the printing unit 25 in the apparatus main body 12.

(9) The paper feeding port 60 opens toward the front surface 12B of the apparatus main body 12, and on the upper surface 12A of the apparatus main body 12, the medium placement surface 51 on which the medium S can be placed is provided so as to be located closer to the front surface 12B side than is the paper feeding port 60 and so as to extend along the paper feeding direction toward the paper feeding port 60. As a result, the user can place the medium S for paper feeding from the front surface 12B side of the apparatus main body 12 on the medium placement surface 51 provided on the upper surface 12A of the apparatus main body 12, and the medium S can be easily fed from the paper feeding port 60 into the upper feeding path 52 by sliding it rearward from the front surface 12B side along the medium placement surface 51.

(10) The medium placement surface 51 is provided on the upper surface of the lid 14, and the lid 14 includes the first lid 41 disposed downstream in the paper feeding direction and the second lid 42 disposed upstream in the paper feeding direction. The first lid 41 is fixed to the casing 13 and the second lid 42 is attached to the casing 13 so as to be displaceable between an open position in which the opening portion 13*a* is open and a closed position in which the opening portion 13*a* is closed. As a result, even if the medium placement surface 51 is provided on the upper surface of the lid 14, the interior of the casing 13 can be viewed by displacing the second lid 42 of the lid 14 to the open position.

(11) The medium placement surface 51 has the inclined surface 45 which is inclined so as to descend from upstream to downstream in the paper feeding direction. As a result, by utilizing the inclination of the inclined surface 45 of the medium placement surface 51, the medium S placed on the medium placement surface 51 is easily fed to the paper feeding port 60. In addition, on the upper surface 12A of the apparatus main body 12, the height of the portion provided with the inclined surface 45 can be lower than the height of the portion without the inclined surface 45.

(12) The medium placement surface 51 has the first placement surface 41*a* disposed on the upper surface of the first lid 41 and the second placement surface 43 disposed on the upper surface of the second lid 42, and the first placement surface 41*a* is inclined so as to descend from upstream to downstream in the paper feeding direction. The second placement surface 43 includes the upstream horizontal surface 43*a* positioned upstream in the paper feeding direction and the downstream inclined surface 43*b* that is inclined so as to descend from upstream to downstream in the paper feeding direction downstream of the upstream horizontal surface 43*a* in the paper feeding direction, and the inclined surface 45 is formed in which the downstream inclined surface 43*b* and the first placement surface 41*a* are continuous in the paper feeding direction. As a result, for example, compared with the case where an inclined surface is provided only in the first lid 41, the area of the inclined surface 45 in the medium placement surface 51 is increased. Therefore, it becomes easier to feed the medium S placed on the medium placement surface 51 toward the paper feeding port 60.

(13) On the first placement surface 41*a*, the edge guides 44 that enable positioning of the medium S placed on the medium placement surface 51 in the width direction X are provided. As a result, it is possible to suppress skewing with respect to the paper feeding direction from occurring on the medium S placed on the medium placement surface 51 by the edge guides 44.

The present embodiment can be implemented with the following modifications. The present embodiment and the following modification examples can be implemented in combination with each other to the extent that they do not conflict technically.

Figure 7:
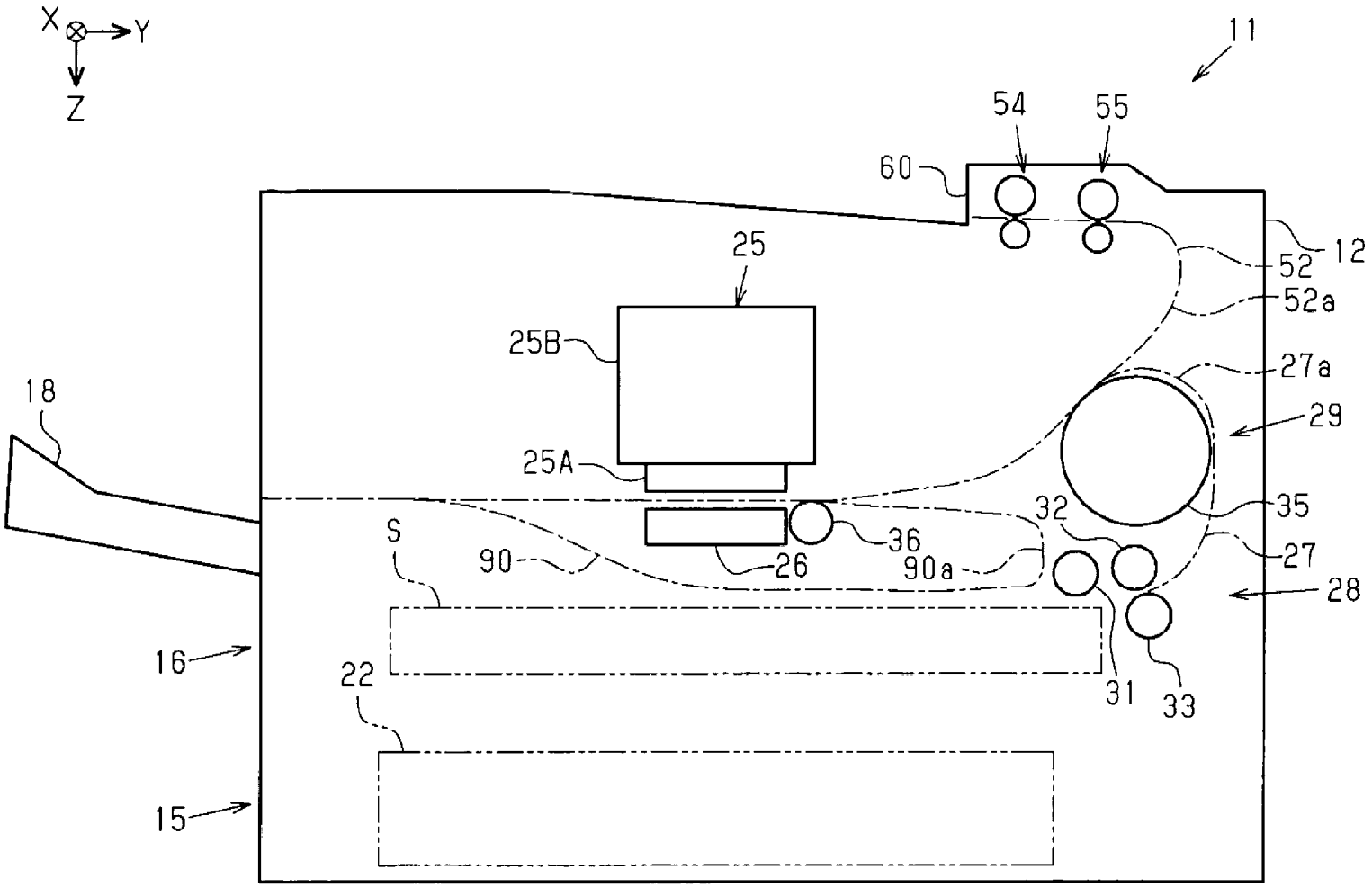
FIG. 7 is a side view illustrating a modification example of the printing apparatus.

As illustrated in FIG. 7, the printing apparatus 11 may be provided with a rear side printing path 90 for printing on the rear side of the medium S. In this modification example, the printing apparatus 11 is provided with the rear side printing path 90 instead of the guide path 76. The printing apparatus 11 may include both the guide path 76 and the rear side printing path 90.

The rear side printing path 90 is a path extending from a position downstream of the printing unit 25 to a position upstream of the printing unit 25. The rear side printing path 90 extends so as to surround the medium supporting portion 26. The rear side printing path 90 has a third curved portion 90*a* for inverting the medium S in the course of guidance.

The third curved portion 90*a* is provided in a middle portion of the rear side printing path 90. The third curved portion 90*a* is a portion of the rear side printing path 90 that is curved. When the medium S is switched back after passing through the printing unit 25, the medium S is guided to the rear side printing path 90. The posture of the medium S is inverted at the third curved portion 90*a* when being fed along the rear side printing path 90. Therefore, by feeding the medium S via the rear side printing path 90, it is possible to print on the rear side of the medium S.

In this modification example, in the depth direction Y, the pair of first rollers 54 are located closer to the side where the printing unit 25 is located than is the third curved portion 90*a*. As a result, the rear side printing path 90 becomes compact. As a result, the printing apparatus 11 becomes compact.

According to this modification example, the following effects can be obtained.

(14) In the depth direction Y, the pair of first rollers 54 are located closer to the side where the printing unit 25 is located than is the third curved portion 90*a*. Consequently, the printing apparatus 11 can be made compact.

The edge guides 44 of the medium placement surface 51 may be omitted.

The edge guides 44 may be provided on the downstream inclined surface 43*b* of the second lid 42 or may be provided on the upstream horizontal surface 43*a*.

The upstream horizontal surface 43*a* of the second lid 42 may be omitted, the entire upper surface of the second lid 42 may be inclined, and the inclined surface 45 may be formed by the entire upper surface of the second lid 42 and the first placement surface 41*a* of the first lid 41.

The entire upper surface of the second lid 42 may be a horizontal surface and the inclined surface 45 may be formed of only the first placement surface 41*a* of the first lid 41.

The inclined surface 45 need not be provided on the upper surface of the lid 14 and the medium placement surface 51 may be a horizontal surface.

In the lid 14, the first lid 41 may be attached to the casing 13 so as to be pivotable, the opening portion 13*a* of the casing 13 can be covered with the first lid 41, and the second lid 42 may be fixed to the casing 13.

The driving roller 54A of the pair of first rollers 54 and the driving roller 55A of the pair of second rollers 55, which make up a portion of the upper feeding portion 53, are disposed in the inverting cover 59; however, the entirety of the upper feeding portion 53 may be disposed in the lid 14 or in the inverting cover 59.

The pair of feeding rollers may be formed of only the pair of second rollers 55 and the pair of first rollers 54 may be omitted.

The medium S is not limited to paper, but may be a plastic film or the like.

The liquid ejected by the printing unit 25 is not limited to ink and, for example, may be a liquid body in which particles of a functional material are dispersed or mixed in a liquid or the like. For example, the printing unit 25 may eject a liquid body containing a material such as an electrode material or a coloring material used for manufacturing a liquid crystal display, an electroluminescence display, a surface emitting display, or the like in a dispersed or dissolved form.

The technical ideas grasped from the embodiment and the modification examples described above and the operation effects thereof are described below.

A printing apparatus includes a printing unit that performs printing on a medium by using a liquid; an apparatus main body that houses the printing unit therein, that is configured to have outer surfaces that include an upper surface and a front surface that adjoiningly intersects the upper surface, and that includes a paper feeding port provided on the upper surface; an upper feeding path configured to guide the medium fed from the paper feeding port toward the printing unit and including a first curved portion in a middle portion thereof for inverting the medium in a course of the guidance; a medium housing portion provided on a lower portion of the apparatus main body and configured to house the medium; and a lower feeding path configured to guide the medium from the medium housing portion toward the printing unit and including a second curved portion in a middle portion thereof for inverting the medium in a course of the guidance, in which an innermost portion of the first curved portion overlaps the second curved portion in a depth direction from the front surface toward a rear surface, which is on a side opposite to the front surface, of the apparatus main body when viewed from the upper surface.

According to this configuration, the innermost portion of the first curved portion of the upper feeding path that guides the medium fed from the paper feeding port that opens on the upper surface of the apparatus main body and the second curved portion of the lower feeding path that guides the medium from the medium housing portion that houses the medium overlap. Consequently, the upper feeding path and the lower feeding path can be made compact. Therefore, it is possible to suppress an increase in the size of the printing apparatus.

A printing apparatus includes a printing unit that performs printing on a medium by using a liquid; an apparatus main body that houses the printing unit therein, that is configured to have outer surfaces that include an upper surface and a front surface that adjoiningly intersects the upper surface, and that includes a paper feeding port provided on the upper surface; an upper feeding path configured to guide the medium fed from the paper feeding port toward the printing unit and including a first curved portion in a middle portion thereof for inverting the medium in a course of the guidance; a mounting portion configured so that a liquid housing portion for housing the liquid is mounted therein; and a liquid tube for guiding the liquid from the liquid housing portion mounted in the mounting portion to the printing unit, in which the printing unit has a carriage configured to move in a width direction of the medium, the liquid tube extends in the width direction and has a turn-back portion, which turns back, in a middle portion thereof, and the upper feeding path and the turn-back portion overlap in a vertical direction when viewed from the front surface.

According to this configuration, because the upper feeding path overlaps the turn-back portion of the liquid tube in the vertical direction, the upper feeding path can be made compact. Therefore, it is possible to suppress an increase in the size of the printing apparatus.

A printing apparatus includes a printing unit that performs printing on a medium by using a liquid; an apparatus main body that houses the printing unit therein, that is configured to have outer surfaces that include an upper surface and a front surface that adjoiningly intersects the upper surface, and that includes a paper feeding port provided on the upper surface; an upper feeding path configured to guide the medium fed from the paper feeding port toward the printing unit and including a first curved portion in a middle portion thereof for inverting the medium in a course of the guidance; and a waste liquid box for housing waste liquid from the printing unit, in which the upper feeding path and the waste liquid box overlap in a depth direction from the front surface toward a rear surface, which is on a side opposite to the front surface, of the apparatus main body when viewed from the upper surface.

According to this configuration, because the upper feeding path and the waste liquid box overlap in the depth direction, the upper feeding path can be made compact. Therefore, it is possible to suppress an increase in the size of the printing apparatus.

The printing apparatus may be configured such that the first curved portion and the carriage overlap in the vertical direction.

According to this configuration, because the first curved portion and the carriage overlap in the vertical direction, the upper feeding path can be made compact.

The printing apparatus may further include a guide path configured to guide the medium from the printing unit to the lower feeding path so as to perform printing on both sides of the medium.

According to this configuration, duplex printing for printing on both sides of the medium can be executed.

The printing apparatus may further include a pair of first rollers that are located closer to a side where the paper feeding port is located than is the first curved portion in the upper feeding path and that feed the medium toward the printing unit via the upper feeding path by rotating while nipping the medium fed from the paper feeding port; and a first feeding roller that feeds the medium while the medium is curved at the second curved portion, in which the pair of first rollers may be located closer to a side where the printing unit is located than is the first feeding roller in the depth direction.

According to this configuration, because the pair of first rollers are located closer to the side where the printing unit is located than is the first feeding roller in the depth direction, the printing apparatus can be made compact.

In the printing apparatus, the pair of first rollers may be located closer to a side where the printing unit is located than is the second curved portion in the depth direction According to this configuration, the printing apparatus can be made compact.

The printing apparatus may include a rear side printing path for performing printing on a rear side of the medium, in which the rear side printing path has a third curved portion for inverting the medium in a course of guidance and the pair of first rollers are located closer to a side where the printing unit is located than is the third curved portion in the depth direction.

According to this configuration, because the pair of first rollers are located closer to the side where the printing unit is located than is the third curved portion in the depth direction, the printing apparatus can be made compact.

A printing apparatus includes a printing unit that performs printing on a medium by using a liquid, an apparatus main body that houses the printing unit therein and that has outer surfaces that include an upper surface and a front surface that adjoiningly intersects the upper surface, a paper feeding port that is provided on the upper surface of the apparatus main body and that enables the medium to be fed into the apparatus main body, an upper feeding path that is capable of guiding the medium fed from the paper feeding port toward the printing unit in the apparatus main body and that has a first curved portion for inverting the medium in the course of guidance, and a pair of feeding rollers that are provided closer to a side where the paper feeding port is located than is the first curved portion in the upper feeding path and that feed the medium toward the printing unit via the upper feeding path by rotating while nipping the medium fed from the paper feeding port from both the front and rear sides.

According to this configuration, the medium fed from the paper feeding port into the apparatus main body and guided toward the printing unit via the upper feeding path abuts against the pair of rollers before the end thereof reaches the first curved portion in the upper feeding path. Then, from this state, the pair of rollers rotate while nipping the medium from the front and rear sides, so that the fed medium is fed to the printing unit along the first curved portion. That is, although the fed medium curves as it passes through the first curved portion of the upper feeding path, before the medium curves, the medium abuts against the pair of feeding rollers and does not become curved. Therefore, it is possible to suppress curving of the fed medium when it is fed through a curved path toward the printing unit in the apparatus main body.

In the printing apparatus, the paper feeding port may open toward a front surface side of the apparatus main body and a medium placement surface on which the medium can be placed may be provided on the upper surface of the apparatus main body so as to extend along a paper feeding direction from the front surface side toward the paper feeding port.

According to this configuration, the user can place the medium for paper feeding on the medium placement surface provided on the upper surface of the apparatus main body from the front surface side of the apparatus main body, and, by sliding the medium placed in such a manner rearward along the medium placement surface from the front surface side, the medium can be easily fed from the paper feeding port into the paper feeding path.

In the printing apparatus, the apparatus main body may include a casing having an opening portion on an upper surface thereof and a lid attached to the casing so as to close the opening portion, the medium placement surface may be provided on the upper surface of the lid, the lid may include a first lid disposed downstream in the paper feeding direction and a second lid disposed upstream in the paper feeding direction, one of the first lid and the second lid being fixed to the casing, and the other being attached to the housing so as to be displaceable between an open position in which the opening portion is open and a closed position in which the opening portion is closed.

According to this configuration, even if the medium placement surface is provided on the upper surface of the lid, by displacing one of the first lid and the second lid among the lids to the open position, it is possible to make the inside of the casing visible.

In the printing apparatus, the medium placement surface may include an inclined surface inclined so as to descend from upstream to downstream in the paper feeding direction.

According to this configuration, by utilizing the inclination of the inclined surface of the medium placement surface, it is easy to feed the medium placed on the medium placement surface to the paper feeding port. In addition, on the upper surface of the apparatus main body, the height of the portion provided with the inclined surface can be lower than the height of the portion without the inclined surface.

In the printing apparatus, the medium placement surface may have a first placement surface disposed on the upper surface of the first lid and a second placement surface disposed on the upper surface of the second lid, the first placement surface may be inclined so as to descend from upstream to downstream in the paper feeding direction, the second placement surface may include an upstream horizontal surface positioned upstream in the paper feeding direction and a downstream inclined surface that is inclined so as to descend from upstream to downstream in the paper feeding direction downstream of the upstream horizontal surface in the paper feeding direction, and the inclined surface may be formed so that the downstream inclined surface of the second placement surface and the first placement surface are continuous in the paper feeding direction.

As a result, for example, compared with the case where an inclined surface is provided only in the first lid, the area of the inclined surface in the medium placement surface is increased. Therefore, it becomes easier to feed the medium placed on the medium placement surface toward the paper feeding port.

In the printing apparatus, on the first placement surface, edge guides that enable positioning of the medium placed on the medium placement surface in the width direction may be provided.

According to this configuration, it is possible to suppress skewing of the medium placed on the medium placement surface with respect to the paper feeding direction from occurring by the edge guides.

What is claimed is:

1. A printing apparatus comprising:

a printing unit that performs printing on a medium by using a liquid;

an apparatus main body that houses the printing unit therein, that is configured to have outer surfaces that include an upper surface and a front surface that adjoiningly intersects the upper surface, and that includes a paper feeding port provided on the upper surface, wherein the medium sits on the upper surface of the main body;

an upper feeding path configured to guide the medium fed from the paper feeding port toward the printing unit and including a first curved portion in a middle portion thereof for inverting the medium in a course of the guidance, the first curved portion having a first portion extending downward toward a rear surface of the apparatus main body to an innermost portion at the middle portion and having a second portion that curves downward from the innermost portion toward the front surface and the printing unit;

a medium housing portion provided on a lower portion of the apparatus main body and configured to house the medium; and a lower feeding path configured to guide the medium from the medium housing portion toward the printing unit and including a second curved portion in a middle portion thereof for inverting the medium in a course of the guidance, wherein the innermost portion of the first curved portion overlaps the second curved portion in a depth direction from the front surface toward the rear surface of the apparatus main body, which is on a side opposite to the front surface, of the apparatus main body when viewed from the upper surface.

2. The printing apparatus according to claim 1, further comprising a guide path configured to guide the medium from the printing unit to the lower feeding path so as to perform printing on both sides of the medium.

3. The printing apparatus according to claim 1, further comprising:

a pair of first rollers that are located closer to a side where the paper feeding port is located than is the first curved portion in the upper feeding path and that feed the medium toward the printing unit via the upper feeding path by rotating while nipping the medium fed from the paper feeding port; and a first feeding roller that feeds the medium while the medium is curved at the second curved portion, wherein the pair of first rollers are located closer to a side where the printing unit is located than is the first feeding roller in the depth direction.

4. The printing apparatus according to claim 3, wherein the pair of first rollers are located closer to a side where the printing unit is located than is the second curved portion in the depth direction.

5. The printing apparatus according to claim 4, further comprising a rear side printing path for performing printing on a rear side of the medium, wherein the rear side printing path has a third curved portion for inverting the medium in a course of guidance, and the pair of first rollers are located closer to a side where the printing unit is located than is the third curved portion in the depth direction.

6. A printing apparatus comprising:

a printing unit that performs printing on a medium by using a liquid;

an apparatus main body that houses the printing unit therein, that is configured to have outer surfaces that include an upper surface and a front surface that adjoiningly intersects the upper surface, and that includes a paper feeding port provided on the upper surface;

an upper feeding path configured to guide the medium fed from the paper feeding port toward the printing unit and including a first curved portion in a middle portion thereof for inverting the medium in a course of the guidance, the first curved portion having a first portion extending downward toward a rear surface of the apparatus main body to an innermost portion at the middle portion and having a second portion that curves downward from the innermost portion toward the front surface and the printing unit;

a mounting portion configured so that a liquid housing portion for housing the liquid is mounted therein; and a liquid tube for guiding the liquid from the liquid housing portion mounted in the mounting portion to the printing unit, wherein the printing unit has a carriage configured to move in a width direction of the medium, the liquid tube extends in the width direction and has a turn-back portion, which turns back, in a middle portion thereof, and the upper feeding path and the turn-back portion overlap in a vertical direction when viewed from the front surface.

7. The printing apparatus according to claim 6, wherein the first curved portion and the carriage overlap in the vertical direction.

8. A printing apparatus comprising:

a printing unit that performs printing on a medium by using a liquid;

an apparatus main body that houses the printing unit therein, that is configured to have outer surfaces that include an upper surface and a front surface that adjoiningly intersects the upper surface, and that includes a paper feeding port provided on the upper surface;

an upper feeding path configured to guide the medium fed from the paper feeding port toward the printing unit and including a first curved portion in a middle portion thereof for inverting the medium in a course of the guidance, the first curved portion having a first portion extending downward toward a rear surface of the apparatus main body to an innermost portion at the middle portion and having a second portion that curves downward from the innermost portion toward the front surface and the printing unit; and a waste liquid box for housing waste liquid from the printing unit, wherein the upper feeding path and the waste liquid box overlap in a depth direction from the front surface toward a rear surface, which is on a side opposite to the front surface, of the apparatus main body when viewed from the upper surface.

* * * * *